US005918975A

United States Patent [19]

Hotchkiss et al.

[11] Patent Number: 5,918,975

[45] Date of Patent: Jul. 6, 1999

[54] MORTAR MIXER WITH POWERED DUMP CONTROL

[75] Inventors: Mark Hotchkiss, Brackney, Pa.; George Barley, Windsor; Thomas Kotasek, Endicott, both of N.Y.

[73] Assignee: Compaction America, Inc., Kewanee, Ill.

[21] Appl. No.: 09/024,433

[22] Filed: Feb. 17, 1998

[51] Int. Cl.[6] ..... B28C 7/16

[52] U.S. Cl. ..... 366/47; 366/185

[58] Field of Search ..... 366/45–48, 64, 366/66, 96–99, 185, 189, 194–196, 606

[56] References Cited

U.S. PATENT DOCUMENTS

| | | | |
|---|---|---|---|
| 1,327,917 | 1/1920 | Kellar | 366/46 |
| 1,577,635 | 3/1926 | Essick | 366/45 |
| 2,155,454 | 4/1939 | Temple | 366/47 |
| 2,668,695 | 2/1954 | Lichtenberg et al. . | |
| 3,905,519 | 9/1975 | Tertinek et al. | 366/45 |
| 4,452,536 | 6/1984 | Hinkle | 366/47 |
| 4,515,510 | 5/1985 | Heward et al. . | |
| 4,699,517 | 10/1987 | Sella | 366/185 |
| 4,895,277 | 1/1990 | Whiteman, Jr. | 366/47 |

FOREIGN PATENT DOCUMENTS

| | | | |
|---|---|---|---|
| 124112 | 3/1919 | United Kingdom | 366/47 |

*Primary Examiner*—Charles E. Cooley
*Attorney, Agent, or Firm*—Salzman & Levy

[57] ABSTRACT

A powered mechanism is described for controlling the dumping of mortar from a tilting mortar mixing drum. The powered mechanism is highly mechanically advantaged, so that a single operator has precise control of the dumping procedure. A mortar mixing drum has a rotatable paddle shaft and at least one paddle attached to it. The mortar mixing drum is operative between a home, mixing position, and a mortar dumping position. A drive mechanism is connected to the rotatable paddle shaft for rotatively driving the shaft and the paddle attached to it. A transmission mechanism has a ring gear attached to the mortar mixing drum and a pinion gear in rotative contact with the ring gear. The transmission mechanism also has a drive belt and a drive pulley rotatively attached to the rotatable paddle shaft. A hand-operated lever is engageable with the drive belt of the transmission mechanism to engage the drive belt for driving the transmission pulley, which causes tilting of the mixing drum.

9 Claims, 3 Drawing Sheets

MORTAR MIXER WITH POWERED DUMP CONTROL

FIELD OF THE INVENTION

The present invention relates to mortar mixers and, more particularly, to a powered dump actuator and control for a tilt-drum, mortar mixer, which reduces the physical labor required to manually dump mortar from the drum.

BACKGROUND OF THE INVENTION

A so-called mortar mixer can be used to mix solid materials (e.g., sand, gravel, cement) and/or liquids, often at a job site. The term "mortar", as used herein, is intended to mean any type(s) of granular and/or liquid materials, without exception. Manually operating a dump mechanism of a tilt-drum mortar mixer increases in difficulty as the cubic feet of load, or capacity of the drum, is increased. It is, therefore, desirable to use the engine/motor (i.e., the source of power for turning the paddle shaft) to provide power for the dumping of mortar from a tilt-drum, mortar mixer.

Previous designs for powering the dumping of mortar, however, either required the addition of costly gear boxes or power sources, or resulted in lack of precise control of the power mechanism. This imprecision often leads to an over-dumping of mortar, and to unsafe conditions in the operation of the drum. The cost of an additional power source is prohibitive for most masonry contractors.

The present invention seeks to provide a simple, yet precise dumping control for a tilt-drum, mortar mixer. Dumping power is provided by the existing, rotating paddle shaft.

This invention controls the dumping operation of the machine during a dumping cycle. The control system provides a control lever mechanism, which, if accidently released, automatically sets a brake, and nullifies the power transmitted to a pinion pulley. These safety measures cause the drum to stay in its current position, until the control lever can be reactivated.

In addition to safety, the present control system also provides the operator with a good "feel" of the clutch/brake mechanism, effecting precise control. A manual dump lever is retained for use in returning the drum to its mixing position, as a backup in case of belt or engine failure, and as a manual control when cleaning the drum.

DISCUSSION OF RELATED ART

In U.S. Pat. No. 2,668,695, issued to Lichtenberg et al on Feb. 9, 1954, for "Drum Mixer with Power-Operated Discharge Positioning Means", the drum driving means is also utilized to move the drum into a discharge position upon completion of the mixing operation. Lichtenberg et al utilize a direct-drive mechanism which eliminates the need for a conventional clutch, although a gear unit is required. The operation of the mechanism is dependent upon the consistency and size of the batch of mixed material. No provision is made for controlled or partial discharging of the drum contents.

In U.S. Pat. No. 4,452,536, issued to Hinkle on Jun. 5, 1984, for "Cart for Relatively Small Concrete Batches and the Like", a tiltable concrete mixing drum is illustrated as part of a portable cart. The rear of the cart is shaped like a chute for facilitating discharge of concrete from the drum when the cart is tilted to release the mix. The tilting is under hydraulic control, necessitating concomitant pumps, tubes, valves, etc.

In U.S. Pat. No. 4,515,510, issued to Heward et al on May 7, 1985, for "Skip Trailer", a tippable mortar bucket is illustrated. The bucket is tipped by means of a powered winch.

SUMMARY OF THE INVENTION

In accordance with the present invention, there is provided a mortar mixer having a powered dump mechanism that can be precisely controlled by the user. The mortar mixer has a mixing drum containing internal vanes or paddles for mixing the mortar therein. The paddles are attached to a rotating, mixing shaft that traverses the mixing drum. A drive pulley of a pulley system is externally attached to the same mixing shaft. The drive pulley is belted to a pinion pulley. The pinion pulley rotatively operates a transmission mechanism for tilting the mixing drum with a sizable mechanical advantage. The belt(s) of the pulley system are normally slack. A dump control lever is disposed adjacent the pulley system. The lever is operative between an idle position and a pulley engaged position. The lever is spring biased toward the idle position. The lever is operatively attached to an idler pulley and forces the idler pulley against the belt(s) in the pulley engaged position. This causes the belt(s) to become taught about the drive pulley and the pinion pulley, thus powering the tilt transmission mechanism. Once empowered, the mixing drum is caused to tilt and discharge its contents.

In the event that the lever is intentionally or accidently released, a brake attached to the lever is forced against the belt(s) and pinion pulley as a result of the extension spring. This causes the drum to stop in its current tilt position, while the belt(s) become slack. The slackening of the belt(s) causes a break in the powering of the tilt mechanism.

It is an object of this invention to provide a powered dumping mechanism for a tilt-drum mortar mixer.

It is another object of the invention to provide a powered dumping mechanism for a tilt-drum mortar mixer that affords precise control of the dumping process.

It is yet another object of this invention to use the existing power source (i.e., the engine/motor) and mixing or paddle shaft of a tilt-drum mortar mixer themselves to empty the contents of the mixer.

It is a further object of this invention to provide a dumping mechanism for a tilt-drum mortar mixer that is easily managed and controlled by a single operator.

It is another object of this invention to provide a safety brake to stop the tilting drum in place, should the dump control lever accidentally be released.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same designation and numbering throughout the figures.

DESCRIPTION OF THE PREFERRED EMBODIMENT

Generally speaking, the invention features a powered mechanism for controlling the dumping of mortar from a tilt-drum mortar mixer. The powered mechanism is highly mechanically advantaged, so that a single operator can precisely control the dumping procedure.

Figure 1:
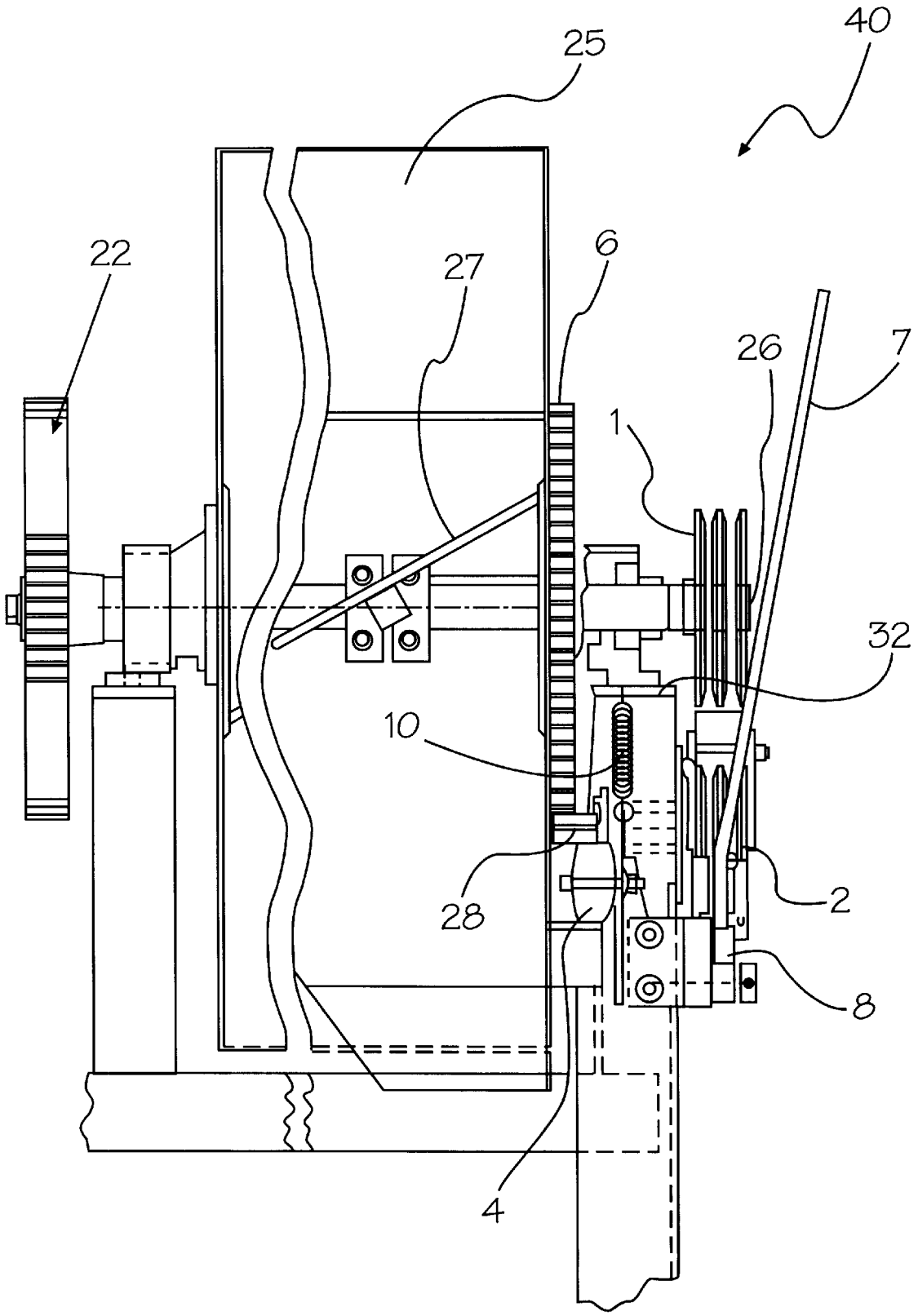
FIG. 1 illustrates a cut-away, side view of the powered dumping mechanism of this invention.
Figure 2:
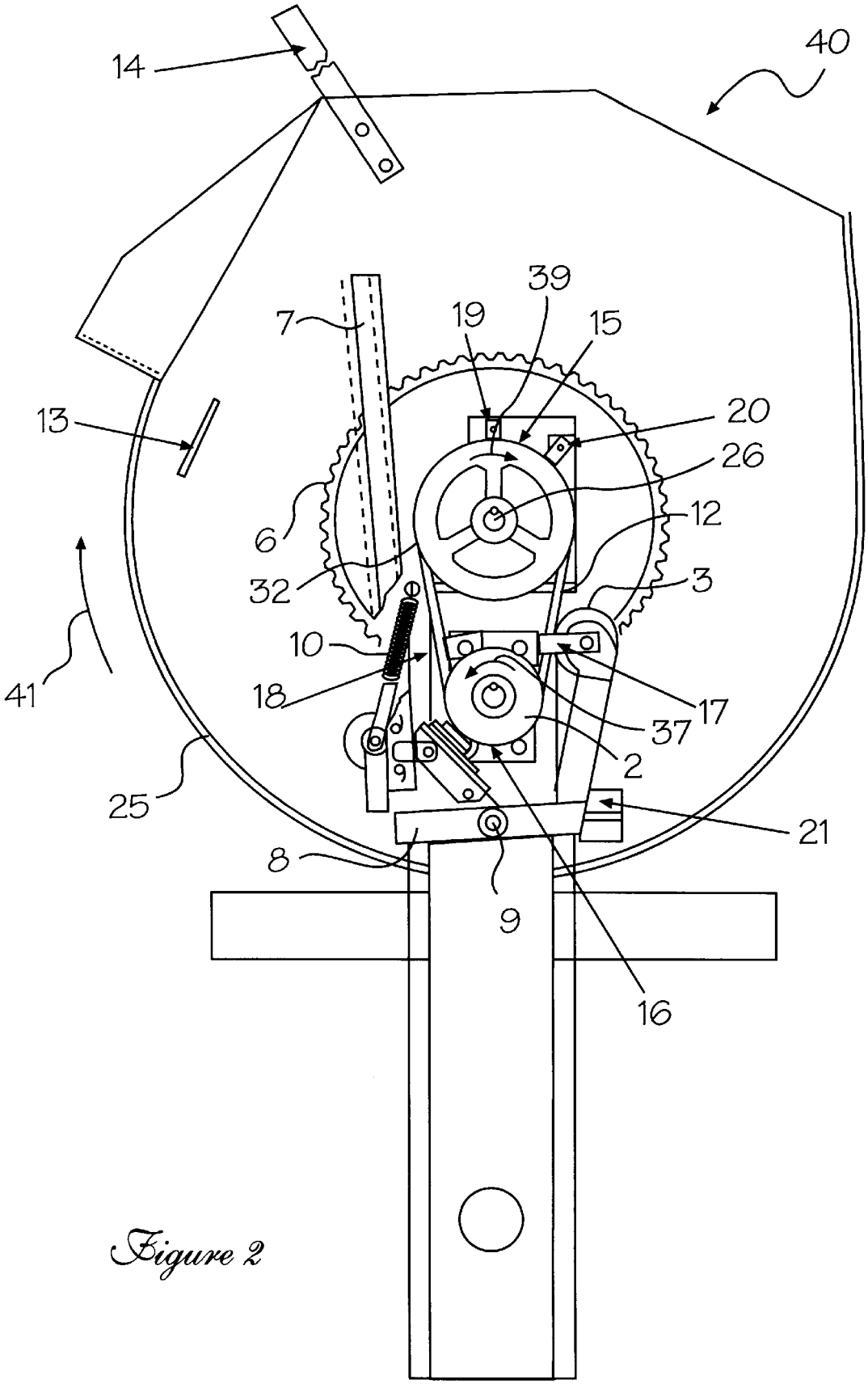
FIG. 2 depicts a front view of the dumping mechanism, shown in FIG. 1, with the drum in a mixing position.
Figure 3:
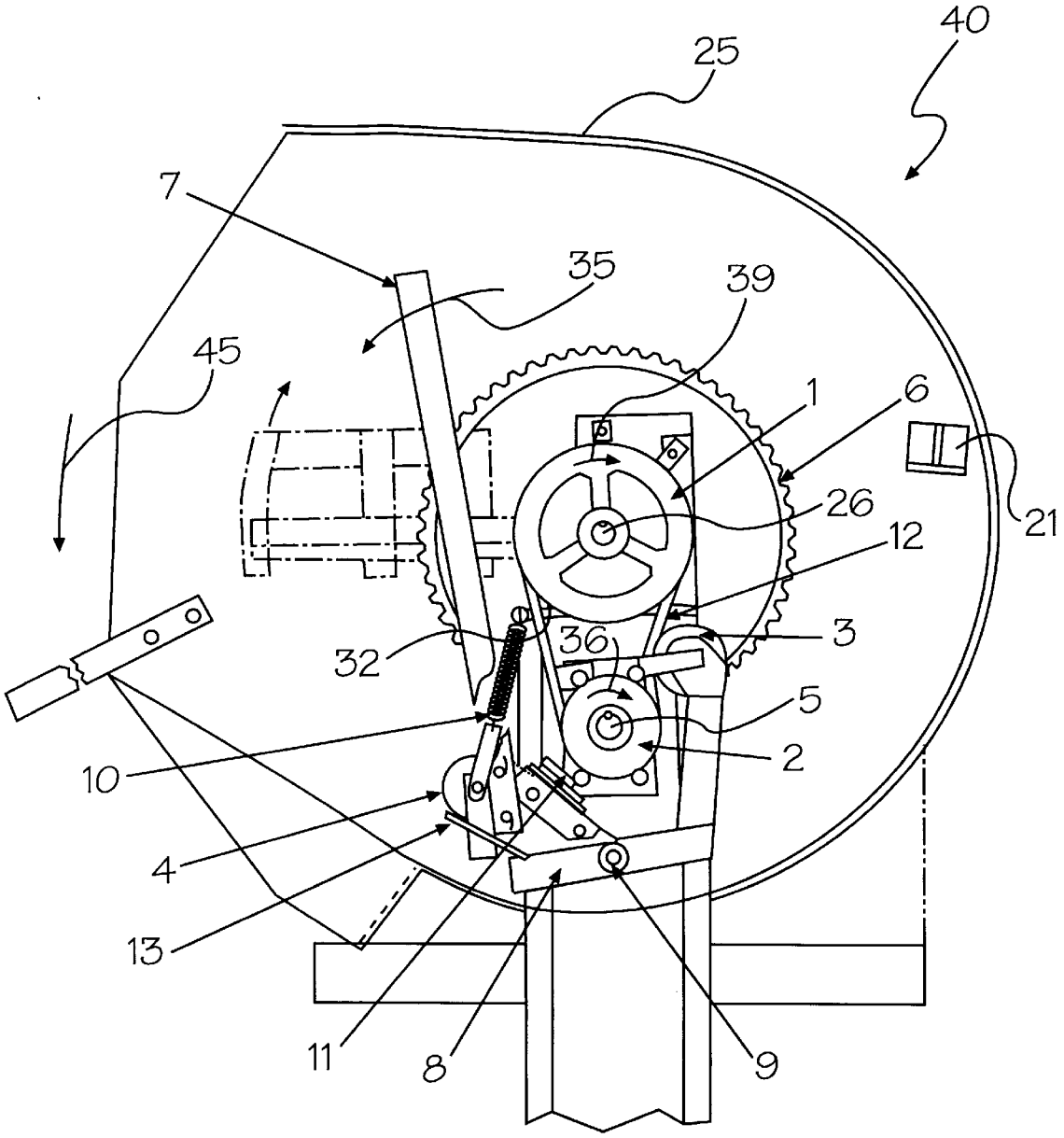
FIG. 3 illustrates a front view of the dumping mechanism, depicted in FIG. 1, with the drum in a dumping position.

Now referring to FIGS. 1 through 3, the powered dumping mechanism 40 of this invention is shown. The mechanism 40 is illustrated in situ with its associated mortar mixing drum 25. A power input gear 22 turns a paddle shaft 26. All of the mixing paddles 27 are attached to the shaft 26, and are caused to rotate slowly (e.g., at approximately 35 rpm) as the power gear 22 turns, thus mixing the mortar contents (not shown) within drum 25.

A belted drive pulley 1 is rotatively attached to the distal end of the mixing shaft 26. The drive pulley 1 drives a pinion transmission pulley 2 via drive belt(s) 12. The pinion pulley 2 is rotatively attached to a pinion gear 28 via pinion gear shaft 5. The pinion gear 28 is engaged with, and drives ring gear 6. Ring gear 6 is affixed to mixing drum 25, causing the drum 25 to tilt when the ring gear 6 is rotated by the pinion gear 28.

Referring to FIG. 2, the mixing drum 25 is shown in a mixing position. A dump control lever 7 is shown in an upright position, and affixed to a control yoke 8, which is pivotable about pivot shaft 9. Attached to the control yoke 8 is an idler pulley 3, which does not engage with belt(s) 12 in the mixing position, thus rendering the belt(s) 12 slack and unmoving. A drum stop 21 is provided to limit its upright movement in a "home" position.

The dump control lever 7 is biased towards its upright position by an extension spring 10 which is attached between fixed support 32 and the pivotable yoke 8.

During mixing, the belt(s) 12 connecting drive pulley 1 to pinion pulley 2 are in a slack state, and drive pulley 1 is free to turn within the slack loop 15. The respective slack loops 15 and 16 are held in place by the four belt guides 17, 18, 19 and 20.

Referring to FIG. 3, the mixing drum 25 is shown in a dumping position. To initiate the tilting of drum 25, the control lever 7 is pulled or pushed counterclockwise (arrow 35), in the dumping direction, causing the control yoke 8 to move a brake 11 away from the belt(s) 12 and the rim of pinion pulley 2. Concurrently, idler pulley 3 tightens the belt(s) 12 around the drive and pinion pulleys 1 and 2, turning the pinion gear 5 in a clockwise direction (arrow 36). This, in turn, drives the ring gear 6, and forces the drum 25 to move in a counterclockwise direction, as shown by arrow 45. The drum 25 is caused to tilt and dump the mortar contained therein.

The belt(s) 12 stay engaged until a nulling cam 13, which is attached to drum 25, comes under the cam follower (roller) 4. The roller 4 is rotatively attached to yoke 8. This causes the control yoke 8 to offset (rotate clockwise) slightly and null the drive provided by belt(s) 12 on the pinion pulley 2. This, in turn, provides a smooth, controlled stop for the now-tilted drum 25. This prevents damage to the belts (due to overload) and keeps the drum lip from contacting the frame.

The drum 25 is maintained in its full dump position by the remaining drive force of the slipping belt(s) 12 in the nulled position.

Should a partial dump be desired, lever 7 is quickly pushed inward (opposite direction to arrow 35), and held. This activates brake 11, which stops pinion pulley 2, while the idler pulley 3 simultaneously releases tension on the belt(s) 12. The drum 25 is held at partial tilt, while the paddles 27 rotate to eject the mortar from drum 25.

To return the drum 25 to the home or mixing position, (arrow 41), the control lever 7 is pulled slightly away from the brake-set position. The drum 25 is returned to the mix position (FIG. 2) by frictional drag of the turning paddles 27 against the side of the drum 25 and/or manual return lever 14, if paddles 27 are adjusted clear of the drum 25. In the return mode, the pinion pulley 2 turns counterclockwise 37 (FIG. 2), or opposite to the direction of the drive pulley 1 (arrow 39). This is made possible due to the slack loop 16 in the belt(s) 12, allowing the pinion pulley 2 to turn within the slack loop. The coiled extension spring 10 keeps the brake 11 set, while the mortar is mixing.

If, during a dump cycle, the control lever 7 is accidently released (i.e., it slips from the hand of the operator), the brake 11 is immediately reset, and the power to pinion pulley 2 is canceled. The drum 25 stays in that position until the control lever 7 is reactivated. This provides safety and gives the operator good control and "feel" of the clutch/brake. The manual dump lever 14, retained for use in case of belt or engine/motor failure, is also useful when cleaning or washing out the drum 25 and manually assisting drum return to an upright position, when required.

The powered dump mechanism is easily controlled by a single operator handling the dump control lever 7, which provides the required mechanical advantage for tilting (arrow 45) the drum 25 to the dump position, independent of the consistency or size of the load, in conjunction with the mechanical power transmission.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A mortar mixing system having a powered dumping mechanism that can be precisely controlled by a single operator, comprising:

a mortar mixing drum having a rotatable paddle shaft and at least one paddle attached thereto, said mortar mixing drum being operative between a home, mixing position, and a mortar dumping position;

drive means operatively connected to said rotatable paddle shaft for rotatively driving said shaft and said at least one paddle attached thereto in order to mix mortar in said drum;

a transmission mechanism comprising a ring gear attached to said mortar mixing drum and a pinion gear in rotative contact with said ring gear; said transmission mechanism further comprising a pulley system, said pulley system comprising a drive belt, a drive pulley rotatively attached to said rotatable paddle shaft and driven by said paddle shaft, and a transmission pulley, said transmission pulley being driven by said drive pulley via said drive belt in said mortar dumping position, and said transmission pulley being rotatively connected to said pinion gear, said drive pulley of said transmission mechanism tilting said mixing drum to said mortar dumping position; and a hand-operated lever operatively engageable with said drive belt of said transmission mechanism, said hand-operated lever being operative to engage said drive belt of said transmission mechanism for driving said transmission pulley, which causes tilting of said mixing drum to said mortar dumping position; said hand-operated lever, in conjunction with said transmission mechanism, providing a mechanical advantage to the tilting of said mixing drum.

2. The mortar mixing system in accordance with claim 1, wherein said pulley system further comprises an idler pulley attached to said hand-operated lever, said drive belt of said pulley system operatively connecting said transmission pulley to said drive pulley of said transmission mechanism when movement of said idler pulley tightens said drive belt of said pulley system between said drive pulley and said transmission pulley, under the influence of said hand-operated lever.

3. The mortar mixing system in accordance with claim 1, wherein said lever is operative between an idle position and a transmission pulley engaged position, said lever being spring biased toward said idle position.

4. The mortar mixing system in accordance with claim 3, wherein said hand-operated lever further comprises a brake operatively attached thereto, said brake being forced against said belt and said transmission pulley by said hand-operated lever stopping said transmission pulley, wherein said mixing drum is stopped in its current tilt position, while said pelt is caused to become slack, and wherein said spring biased lever is caused to apply said brake automatically when said lever is released by an operator.

5. The mortar mixing system in accordance with claim 4, further comprising belt guides proximate said drive and transmission pulleys for permitting said pulleys to rotate within said slack belt.

6. The mortar mixing system in accordance with claim 1, wherein said hand-operated lever further comprises a brake operatively attached thereto, said brake being forced against said belt and said transmission pulley by said hand-operated lever stopping said transmission pulley, wherein said mixing drum is stopped in its current tilt position, while said belt is caused to become slack.

7. The mortar mixing system in accordance with claim 6, further comprising belt guides proximate said drive and transmission pulleys for permitting said pulleys to rotate within said slack belt.

8. The mortar mixing system in accordance with claim 1, further comprising first and second stop means operatively connected to said mixing drum for respectively positioning said mixing drum in said mixing position and said mortar dumping position.

9. The mortar mixing system in accordance with claim 8, wherein said second stop means comprises a cam follower that disengages said transmission mechanism to interrupt said tilting of said mortar mixing drum.

* * * * *